US010946643B2

(12) United States Patent
Kumagai et al.

(10) Patent No.: US 10,946,643 B2
(45) Date of Patent: Mar. 16, 2021

(54) LIQUID EJECTION DEVICE AND METHOD FOR DRIVING LIQUID EJECTION DEVICE

(71) Applicant: SEIKO EPSON CORPORATION, Tokyo (JP)

(72) Inventors: Shiki Kumagai, Shiojiri (JP); Masashi Kamibayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/717,769

(22) Filed: Dec. 17, 2019

(65) Prior Publication Data

US 2020/0198324 A1 Jun. 25, 2020

(30) Foreign Application Priority Data

Dec. 20, 2018 (JP) ..... JP2018-237875

(51) Int. Cl.
*B41J 2/045* (2006.01)
*B41J 2/165* (2006.01)

(52) U.S. Cl.
CPC ..... *B41J 2/0451* (2013.01); *B41J 2/04586* (2013.01); *B41J 2/165* (2013.01)

(58) Field of Classification Search
CPC ..... B41J 2/0451; B41J 2/04586; B41J 2002/16555; B41J 2/16505; B41J 2/16523; B41J 2002/16514
See application file for complete search history.

(56) References Cited

U.S. PATENT DOCUMENTS 5,912,681 A 6/1999 Uetuki et al.
6,036,299 A * 3/2000 Kobayashi ..... B41J 2/1652 347/30
8,820,887 B2 * 9/2014 Kamiyama ..... B41J 2/16552 347/29

FOREIGN PATENT DOCUMENTS

JP H08174856 7/1996
JP 2003334961 11/2003
JP 2009285869 12/2009

* cited by examiner

*Primary Examiner* — Thinh H Nguyen
(74) *Attorney, Agent, or Firm* — Workman Nydegger

(57) ABSTRACT

A liquid ejection head includes a nozzle face provided with a nozzle configured to eject a liquid, a cap member configured to contact the nozzle face at a position enclosing the nozzle and to be fitted so as to cover the nozzle, the cap member being formed with an atmosphere communication hole to place an inside of the cap member and a surrounding atmosphere in communication with each other, and a clog determination mechanism configured to determine whether or not the atmosphere communication hole is in an at least partially blocked state.

4 Claims, 8 Drawing Sheets

LIQUID EJECTION DEVICE AND METHOD FOR DRIVING LIQUID EJECTION DEVICE

The present application is based on, and claims priority from JP Application Serial Number 2018-237875, filed Dec. 20, 2018, the disclosure of which is hereby incorporated by reference herein in its entirety.

BACKGROUND

1. Technical Field

The present disclosure relates to a liquid ejection device.

2. Related Art

Ink jet printers that eject ink through nozzles are known. In such ink jet printers, in order to prevent evaporation of ink in the ink-ejecting nozzles and an accompanying increase in the viscosity of the ink when the printer is not in use, a cap may be fitted over a head in which the nozzles are provided. Although a cap capable of sealing the head would be preferable from the perspective of preventing ink evaporation, if the head were completely sealed, the pressure inside the sealed space would fluctuate, affecting the meniscus of the ink in the nozzles. Thus, a very small atmosphere communication hole is provided in the cap (for example, JP-A-8-174856).

However, since such an atmosphere communication hole is configured by a very small opening in order to suppress ink evaporation, the opening might become blocked, for example due to ink dripping down from the nozzles. In a case in which this blockage of the atmosphere communication hole goes unnoticed and the atmosphere communication hole is left blocked, the meniscus of the ink in the nozzles might be broken when the cap is fitted over the head, resulting in poor ink ejection.

SUMMARY

One aspect of the present disclosure provides a liquid ejection head including a nozzle face provided with a nozzle configured to eject a liquid. The liquid ejection head further includes a cap member configured to contact the nozzle face at a position enclosing the nozzle and to be fitted so as to cover the nozzle, the cap member being formed with an atmosphere communication hole to place an inside of the cap member and a surrounding atmosphere in communication with each other, and a clog determination mechanism configured to determine whether or not the atmosphere communication hole is in an at least partially blocked state.

DESCRIPTION OF EXEMPLARY EMBODIMENTS

A. Embodiment 1

Figure 1:
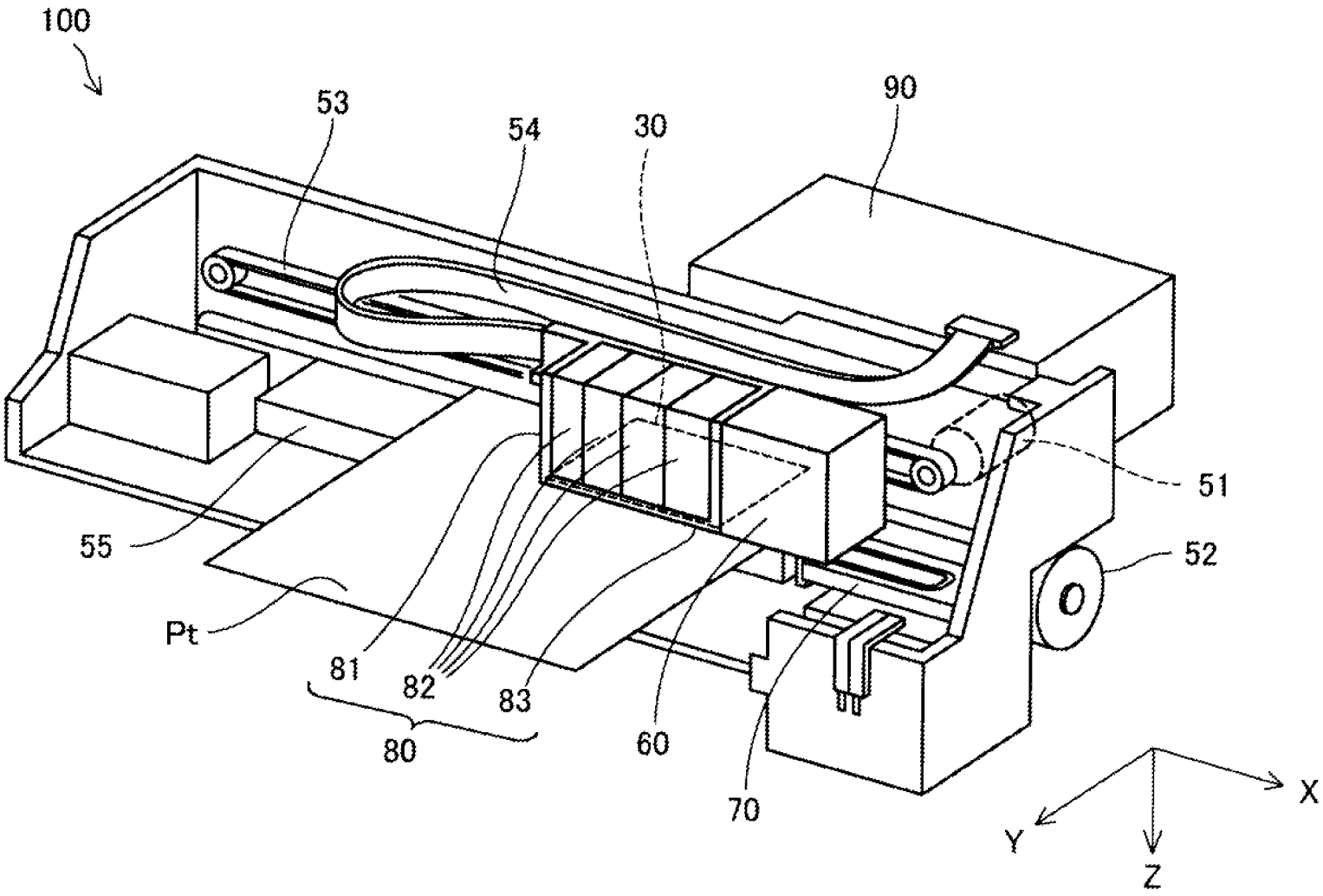
FIG. 1 is a schematic configuration diagram of a printing device serving as an example of a liquid ejection device of an embodiment.

FIG. 1 is a schematic configuration diagram of a printing device 100. The printing device 100 is a serial ink jet printer, and serves as an example of a liquid ejection device. The printing device 100 prints by ejecting liquid ink onto a recording medium Pt such as printing paper to form dots based on print data input from an image forming device. FIG. 1 illustrates an X direction, a Y direction, and a Z direction. The X direction is a direction running along a main scanning direction, this being a width direction of the recording medium Pt, and the Y direction is a direction running along a sub-scanning direction, this being a transportation direction of the recording medium Pt. The Z direction is a direction running along the direction of gravity, and is an ejection direction of ink from a liquid ejection head 83 in the present embodiment.

A head unit 80 serves as an ink ejection unit of the printing device 100, and is configured by a carriage 81, ink cartridges 82, and the liquid ejection head 83. The head unit 80 is electrically coupled to a control section 90 through a flexible cable 54. The head unit 80 is attached to a non-illustrated carriage guide, and is moved back and forth along the X direction that is the main scanning direction by drive force of the carriage motor 51 transmitted through a drive belt 53.

The plural ink cartridges 82 corresponding to various ink colors are loaded into the carriage 81. In the present embodiment, four types of ink cartridge 82 are provided, these being cyan (Cy), magenta (Ma), yellow (Ye), and black (Bk). Besides light cyan (Lc) and light magenta (Lm), various type of white ink (Wt) such as a pearl white ink to which a metallic luster is imparted, or a transparent ink (Op) used to adjust the luster of a printed image or for treatment prior to printing, may also be employed.

The liquid ejection head 83 includes a nozzle face 30 on a Z direction surface side facing the recording medium Pt. Head chips corresponding to the above-mentioned types of ink are provided to the nozzle face 30. Each of the head chips is provided with nozzles, namely openings through which ink droplets are ejected. The liquid ejection head 83 is coupled to the carriage 81, and ejects ink toward the recording medium Pt through the nozzles provided in the nozzle face 30 while moving back and forth along the X direction.

A transportation motor 52 is driven in response to a control signal from the control section 90. Non-illustrated transportation rollers are rotated by drive force from the transportation motor 52 to transport the recording medium Pt over a platen 55 along the Y direction, this being the sub-scanning direction. In the present embodiment, the sub-scanning direction is orthogonal to the main scanning direction; however, the sub-scanning direction is not limited to being orthogonal, and may intersect the main scanning direction at any desired angle.

The control section 90 is configured by memory and a CPU, and executes overall control of the printing device 100. The control section 90 transmits/receives data with the image forming device through a non-illustrated interface, and outputs a drive signal to the liquid ejection head 83. Ink is ejected through the nozzles provided to the liquid ejection head 83 based on this drive signal. When print data is output from the image forming device, the control section 90 drives the carriage motor 51 to move the head unit 80 back and forth along the X direction. The control section 90 repeatedly alternates between control to eject ink onto the recording medium Pt using the liquid ejection head 83 and control to transport the recording medium Pt along the Y direction using the transportation motor 52 to print an image on the recording medium Pt.

Figure 2:
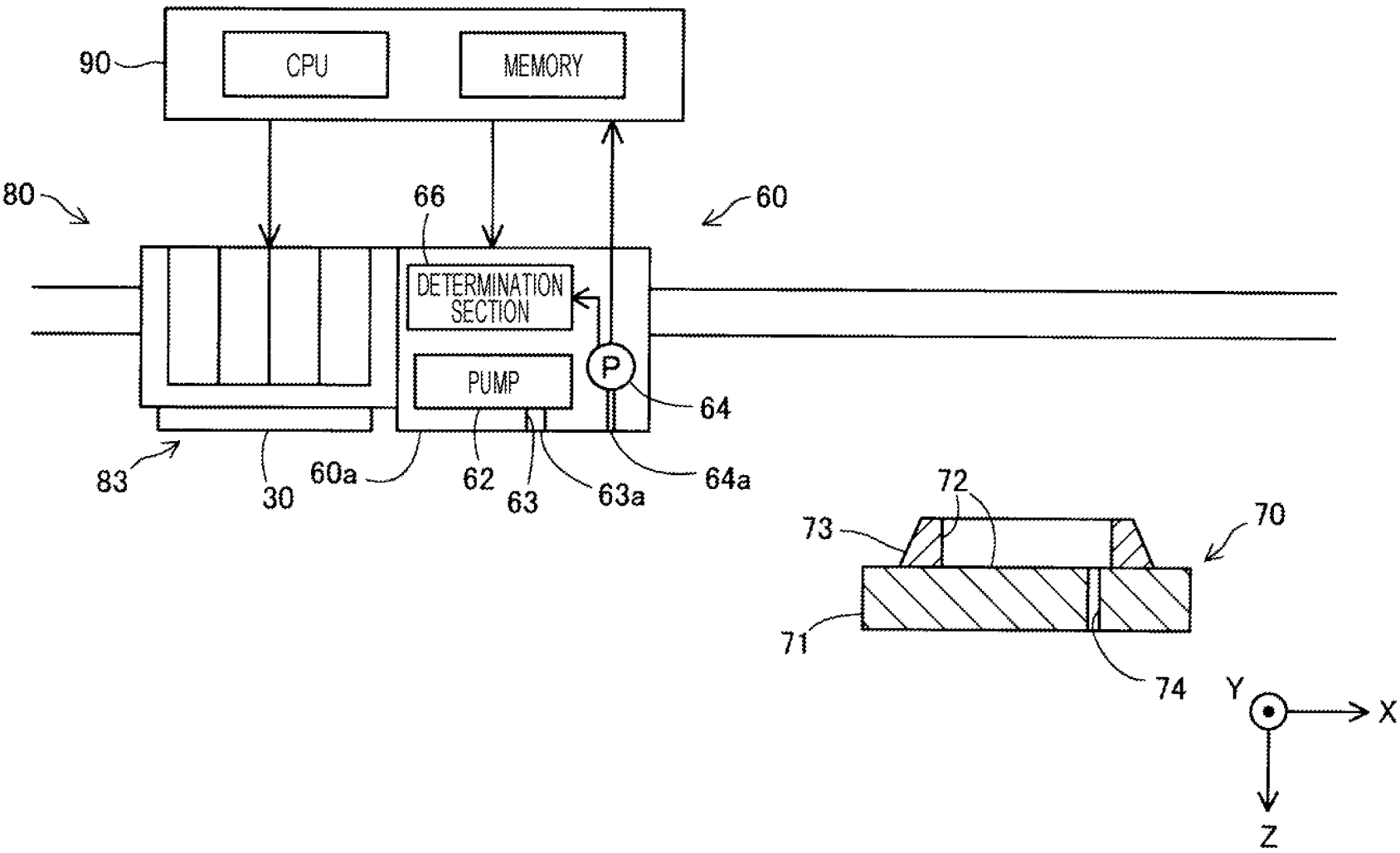
FIG. 2 is a schematic explanatory diagram illustrating configuration of a clog determination mechanism and a cap member.

Next, explanation follows regarding configuration of a cap member 70 and a clog determination mechanism 60 provided to the printing device 100 of the present embodiment, with reference to FIG. 1 and FIG. 2. FIG. 2 is a schematic explanatory diagram illustrating configuration of the cap member 70 and the clog determination mechanism 60. FIG. 2 includes a block diagram illustrating configuration of the clog determination mechanism 60, and a section of the cap member 70.

The cap member 70 is a mechanism to protect the nozzles formed in the nozzle face 30 of the liquid ejection head 83. The cap member 70 is moved up and down along the Z direction by a non-illustrated drive mechanism. In the present embodiment, the cap member 70 is provided in the vicinity of a home position positioned outside a printing region of the printing device 100. The home position is a position where the head unit 80 stands by when the printing device 100 is not printing.

As illustrated in FIG. 2, the cap member 70 is configured by a base 71, and a gasket 73 provided on the side of the base 71 that faces the nozzle face 30, namely, on the opposite side to the Z direction. In the present embodiment, the gasket 73 is configured by a resin sealing material with gas sealing properties; however, metal or various other materials with strong airtight properties may be employed. The gasket 73 includes a through-hole of a size capable of enclosing the nozzles of the nozzle face 30. A cap recess 72 is formed by inner walls of the through-hole in the gasket 73 and a face of the base 71 on the side facing the nozzle face 30.

An atmosphere communication hole 74 is provided in the base 71. One end of the atmosphere communication hole 74 opens at part of a bottom face of the cap recess 72 inside the cap member 70, and the other end thereof opens to the exterior of the cap member 70. Namely, the atmosphere communication hole 74 is a through-hole that penetrates the interior of the base 71 along the Z direction, and that places an interior space enclosed by the cap recess 72 and the surrounding atmosphere in communication with each other. The opening on one end side of the atmosphere communication hole 74 is very small in size compared to the area of an opening in the gasket 73. In the present embodiment, the atmosphere communication hole 74 is formed as a through-hole with a diameter of 1 mm.

The clog determination mechanism 60 is a device for determining whether or not the atmosphere communication hole 74 in the cap member 70 is blocked. The clog determination mechanism 60 is also simply referred to as a determination mechanism 60 below. The determination mechanism 60 is fixed to the carriage 81 at a position adjacent to the head unit 80.

As illustrated in FIG. 2, the determination mechanism 60 includes a pump 62, a supply path 63, a pressure sensor 64, and a determination section 66 inside substantially rectangular casing. The pump 62 is a small diaphragm pump serving as a pressure adjustment section that conveys air under pressure to the exterior of the determination mechanism 60 through the supply path 63 in the Z direction. The pressure sensor 64 is a diaphragm-type sensor serving as a pressure detection section that measures pressure in the vicinity of the supply path 63. A measurement result from the pressure sensor 64 is converted into an electric signal and output to the determination section 66 and the control section 90. In the present embodiment, a Z direction side surface 60*a* of the determination mechanism 60 has a planar shape, and the surface 60*a* functions as a fitting section onto which the cap member 70 is fitted. An opening 63*a* of the supply path 63 from the pump 62 and a measurement opening 64*a* of the pressure sensor 64 are provided in the surface 60*a*.

The determination section 66 is a control device configured by a non-illustrated CPU and memory provided inside the determination mechanism 60. The determination section 66 may be configured externally to the determination mechanism 60, and may for example be provided within the control section 90. The determination section 66 employs a pressure measurement result detected by the pressure sensor 64 to determine whether or not the atmosphere communication hole 74 is blocked. The determination section 66 performs this function when the CPU of the determination mechanism 60 reads a program from the memory.

Figure 3:
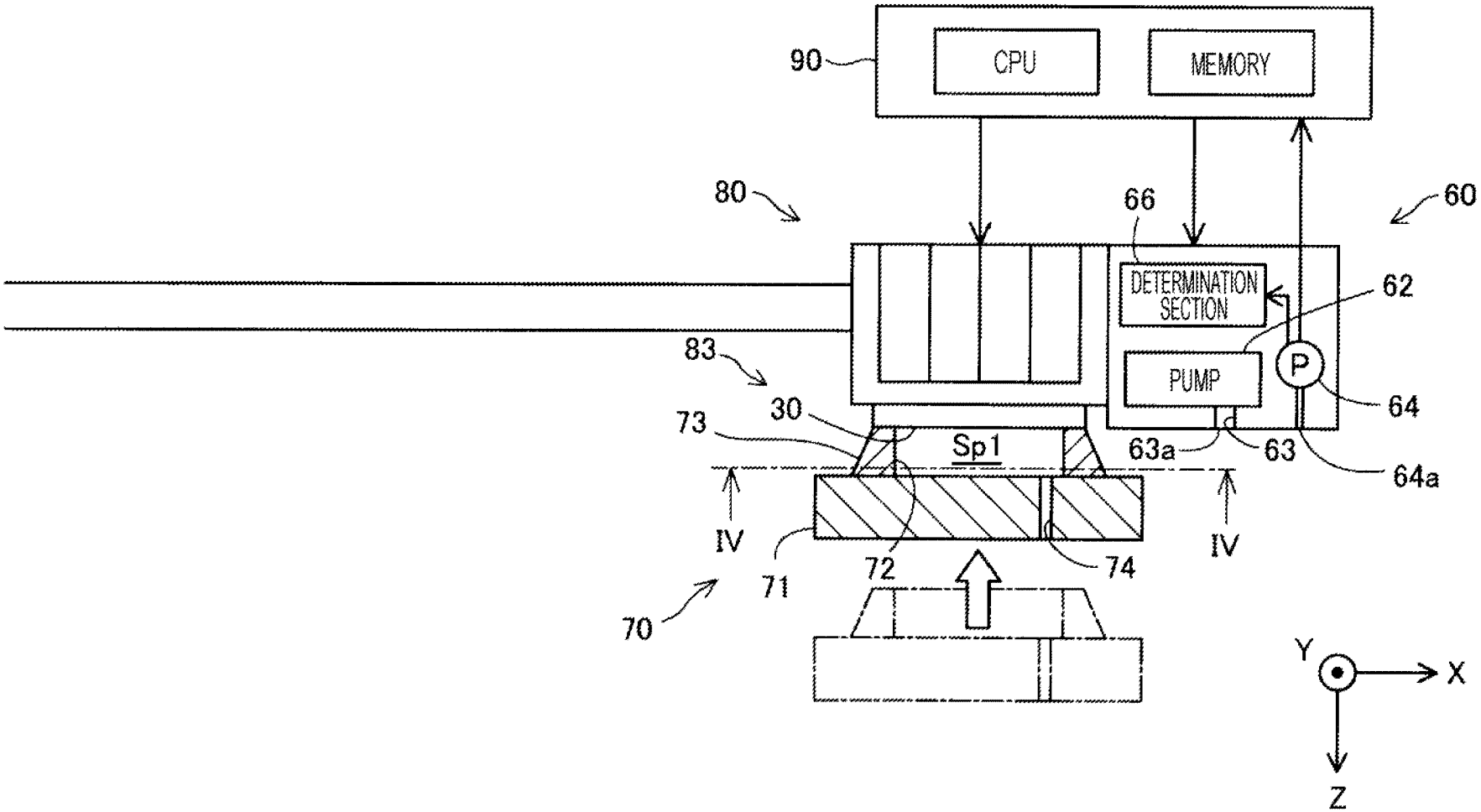
FIG. 3 is a schematic explanatory diagram illustrating a state in which the cap member is contacting a head unit.
Figure 4:
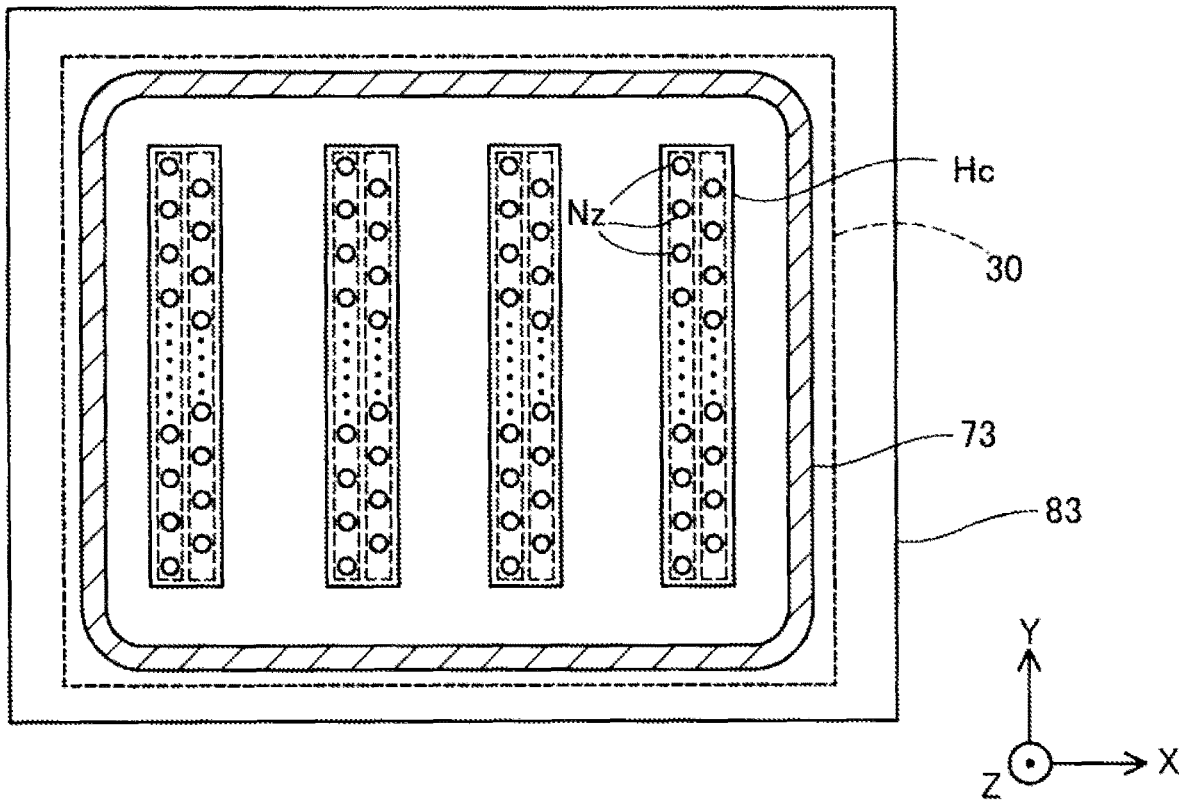
FIG. 4 is a schematic section illustrating a state in which the cap member is contacting a nozzle face.

Next, explanation follows regarding functionality of the cap member 70, with reference to FIG. 3 and FIG. 4. FIG. 3 is a schematic explanatory diagram illustrating a state in which the cap member 70 is contacting the head unit 80. FIG. 4 is a schematic section illustrating a state in which the cap member 70 is contacting the nozzle face 30 of the liquid ejection head 83. For example, when printing processing has ended, the printing device 100 actuates the carriage motor 51 to move the head unit 80 to the home position so as to oppose the cap member 70 as illustrated by the single-dotted dashed lines in FIG. 3.

As illustrated in FIG. 4, the nozzle face 30 is provided on the Z direction side of the liquid ejection head 83. Although the nozzle face 30 is provided with one head chip Hc for each ink type, configuration may be made in which plural head chips Hc are provided for each ink type. Each of the head chips is provided with nozzles Nz, these being openings through which ink droplets are ejected. The quantity and layout of the nozzles in the liquid ejection head 83 may be set as appropriate according to the resolution of the printing device 100 and so on.

As illustrated in FIG. 3, the cap member 70 is raised by the non-illustrated drive mechanism such that the cap member 70 contacts the nozzle face 30 of the liquid ejection head 83 at a position where an upper end portion of the gasket 73 encloses the nozzles Nz as illustrated in FIG. 4. As illustrated in FIG. 3, the cap member 70 is fitted such that the cap recess 72 covers the nozzles Nz, thus forming an airtight space Sp1 in the vicinity of the nozzles Nz. The space Sp1 refers to a space enclosed by the cap recess 72 and the nozzle face 30, and does not include the atmosphere communication hole 74. By thus forming the space Sp1 in the vicinity of the nozzles Nz during non-printing periods when the printing device 100 is not printing, the cap member 70 maintains the nozzle face 30 in a moist state, thereby preventing the evaporation of ink inside the nozzles Nz and an accompanying increase in ink viscosity. The atmosphere communication hole 74 is in communication with the surrounding atmosphere and exposes the space Sp1 to the surrounding atmosphere such that the space Sp1 is not completely sealed. This suppresses any effect on the meniscus of the ink inside the nozzles Nz caused by pressure fluctuations inside the space Sp1.

Figure 5:
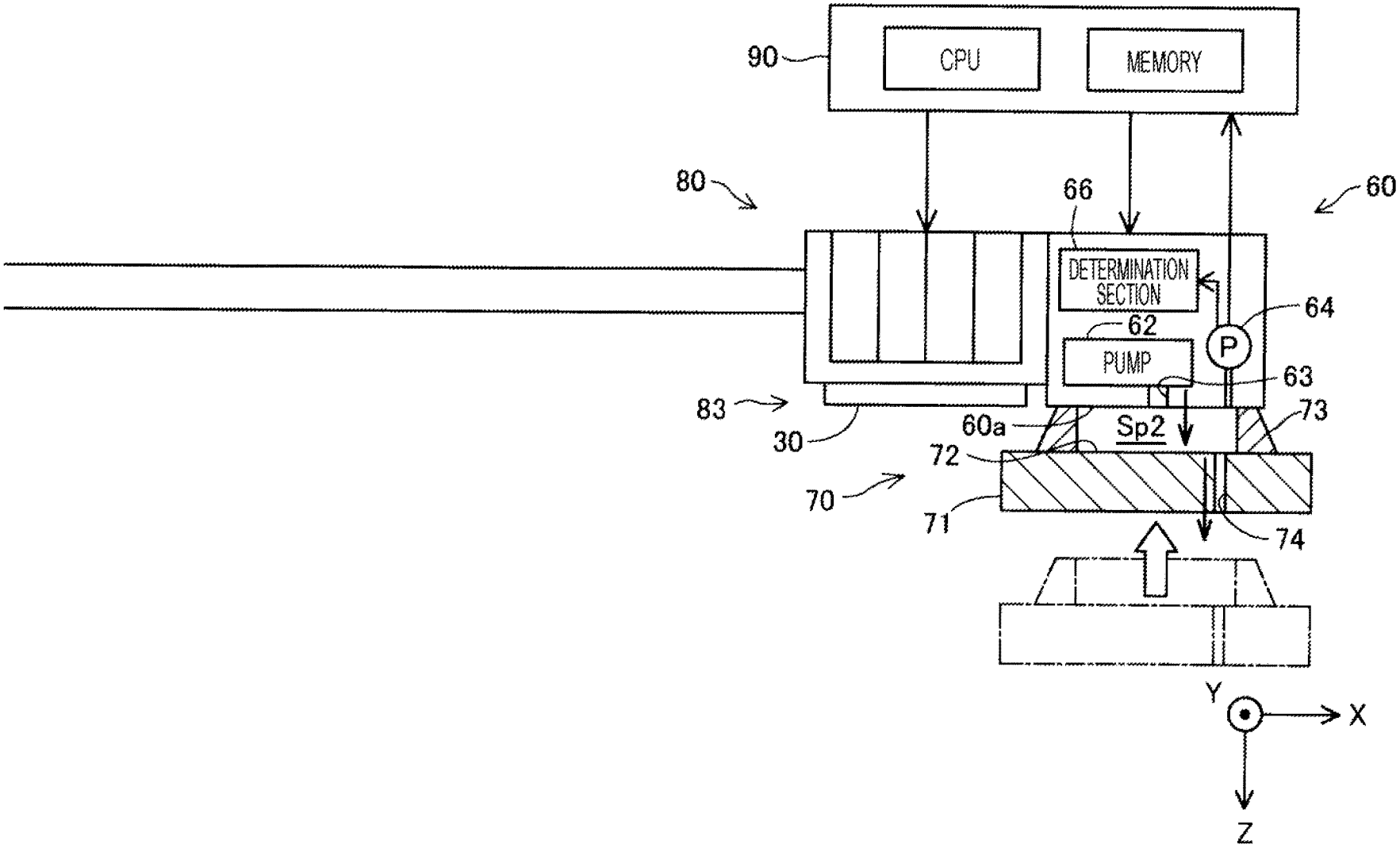
FIG. 5 is a schematic explanatory diagram illustrating a state in which the cap member is contacting a determination mechanism.

Next, explanation follows regarding functionality of the determination mechanism 60, with reference to FIG. 5. FIG. 5 is a schematic explanatory diagram illustrating a state in which the cap member 70 is contacting the determination mechanism 60. The determination mechanism 60 is moved to the home position together with the above-described head unit 80 by drive force of the carriage motor 51. The cap member 70 is raised by the drive mechanism so as to contact the determination mechanism 60. In the present embodiment, the gasket 73 of the cap member 70 contacts the surface 60*a* configuring the fitting section of the determination mechanism 60. When this occurs, the gasket 73 of the cap member 70 is fitted so as to cover the opening 63*a* of the supply path 63 and the measurement opening 64*a* of the pressure sensor 64 in the Z direction side surface 60*a* of the determination mechanism 60. An airtight space Sp2 is thereby formed in the vicinity of the supply path 63. The space Sp2 refers to a space enclosed by the cap recess 72 and the determination mechanism 60, and does not include the atmosphere communication hole 74.

FIG. 5 illustrates an example of the cap member 70 in a normal state in which the atmosphere communication hole 74 is not blocked. The control section 90 actuates the pump 62 in a state in which the cap member 70 has been fitted onto the determination mechanism 60 so as to convey air under pressure through the supply path 63 into the space Sp2. The internal pressure inside the space Sp2 rises due to the air conveyed under pressure by the pump 62, while the air gradually escapes to the exterior through the atmosphere communication hole 74. The pressure inside the space Sp2 is detected by the pressure sensor 64 and output to the determination section 66.

Figure 6:
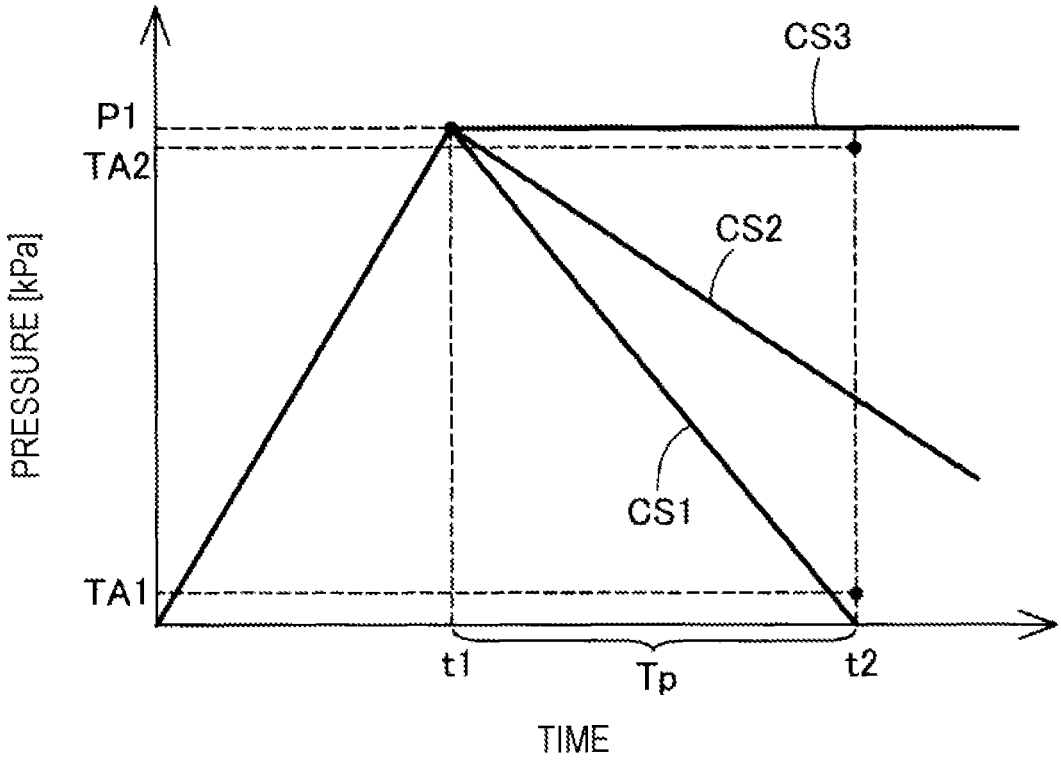
FIG. 6 is a graph illustrating changes in internal pressure inside a space enclosed by the cap member and the determination mechanism.
Figure 7:
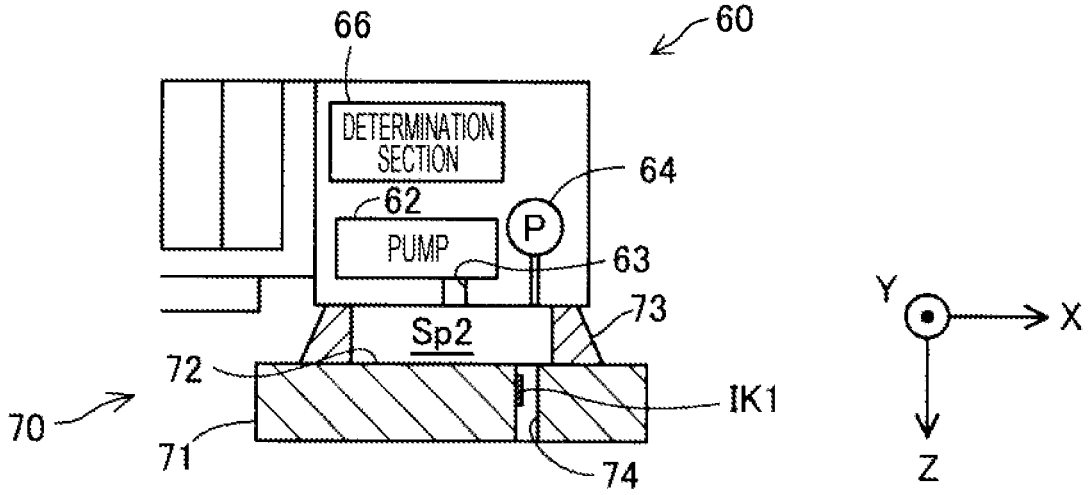
FIG. 7 is an explanatory diagram illustrating the cap member in a state in which an atmosphere communication hole is partially blocked.
Figure 8:
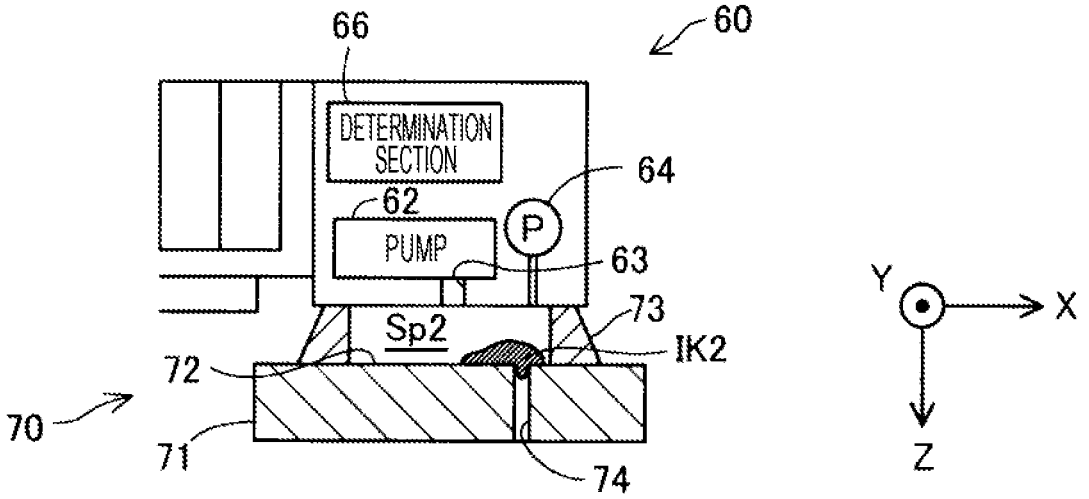
FIG. 8 is an explanatory diagram illustrating the cap member in a state in which the atmosphere communication hole is completely blocked.

Next, explanation follows regarding determination by the determination mechanism 60 of a blocked state of the atmosphere communication hole 74 in the cap member 70, with reference to FIG. 6 to FIG. 8 in addition to FIG. 5. FIG. 6 is a graph illustrating pressure changes inside the space Sp2. FIG. 6 illustrates pressure changes for respective states CS1 to CS3, corresponding to different blockage states of the atmosphere communication hole 74. Note that although in reality the rate of pressure change before reaching a pressure P1 described below would differ for each of the states CS1 to CS3, these rates of change are represented by a single rate of change in order to facilitate understanding of the technology.

The state CS1 is an example of pressure change in the space Sp2 in a normal state in which the atmosphere communication hole 74 is not blocked, namely, as would be obtained by the cap member 70 illustrated in FIG. 5. As previously described, the pump 62 conveys air under pressure to the interior of the space Sp2 in a state in which the cap member 70 has been fitted over the determination mechanism 60. Since the atmosphere communication hole 74 is a very small opening compared to the opening area of the gasket 73, the amount of air that escapes through the atmosphere communication hole 74 is small in comparison to the amount of air supplied by the pump 62. Thus, when the pump 62 is operated, the pressure inside the space Sp2 begins to rise from atmospheric pressure. The control section 90 stops the pump 62 when the internal pressure of the space Sp2 has reached the predetermined pressure P1, serving as a target value. The time when the internal pressure of the space Sp2 reaches the pressure P1 is denoted as a timing t1.

As described above, the air inside the space Sp2 gradually escapes to the exterior through the atmosphere communication hole 74. Thus as illustrated for the state CS1 in FIG. 6, when the pump 62 is stopped, the pressure inside the space Sp2 gradually drops from the pressure P1 toward the atmospheric pressure. In the state CS1, a period until the pressure P1 reaches atmospheric pressure is denoted as a period Tp. This period Tp can be computed in advance based on the flow path resistance of the atmosphere communication hole 74 as determined by the opening diameter of the atmosphere communication hole 74, the volume of the space Sp2, and so on. In the present embodiment, the period Tp is computed in advance and stored in the memory of the determination section 66. In the state CS1, the time when the period Tp elapses after the timing t1 when the pressure P1 is reached, namely, the time when the internal pressure of the space Sp2 reaches atmospheric pressure, is denoted as a timing t2.

FIG. 7 is a schematic explanatory diagram illustrating the cap member 70 in a state in which the atmosphere communication hole 74 is partially blocked. FIG. 7 illustrates a state corresponding to the state CS2 in FIG. 6, namely illustrates a state in which ink IK1, serving as an example of a cause of the partial blockage of the atmosphere communication hole 74, is present inside the atmosphere communication hole 74. The ink IK1 partially blocks the atmosphere communication hole 74 but does not completely block the atmosphere communication hole 74. The ink IK1 is for example caused by agglomeration of ink mist when the cap member 70 is contacting the nozzle face 30 of the liquid ejection head 83.

The pressure change illustrated by the state CS2 in FIG. 6 is an example of a pressure change inside the space Sp2 formed by the cap member 70 in a state in which the flow path of the atmosphere communication hole 74 is partially blocked, namely, in the state illustrated in FIG. 7. The rate of escape of air through the atmosphere communication hole 74 in the state CS2 is thus lower than that in the state CS1. Accordingly, in the state CS2, after the internal pressure of the space Sp2 reaches the pressure P1, the internal pressure drops toward atmospheric pressure at a lower rate of change than in the state CS1.

FIG. 8 is a schematic explanatory diagram illustrating the cap member 70 in a state in which the atmosphere communication hole 74 is completely blocked. FIG. 8 illustrates a state corresponding to the state CS3 in FIG. 6, namely illustrates a state in which ink IK2, serving as an example of a cause of the blockage of the atmosphere communication hole 74, has completely blocked the opening on a cap recess 72 side of the atmosphere communication hole 74. The ink IK2 is for example caused by ink dripping from the nozzles Nz, or dirt or dust that adheres when the cap member 70 contacts the nozzle face 30 of the liquid ejection head 83.

The pressure change illustrated by the state CS3 in FIG. 6 is an example of a pressure change inside the space Sp2 formed by the cap member 70 in a state in which the atmosphere communication hole 74 is completely blocked, namely, in the state illustrated in FIG. 8. In the state CS3, since air does not escape through the atmosphere communication hole 74, after reaching the pressure P1 a state persists in which the internal pressure of the space Sp2 remains at the pressure P1. Namely, the rate of change of the internal pressure of the space Sp2 in the state CS3 is even lower than the rate of change in the state CS2, and is substantially zero.

Next, explanation follows regarding a first threshold value TA1 and a second threshold value TA2 employed by the determination section 66 to determine a blocked state of the atmosphere communication hole 74, with reference to FIG. 6. In the present embodiment, pressure values are set as the respective threshold values TA1, TA2. More specifically, the first threshold value TA1 is substantially the same value as the pressure inside the space Sp2 at the timing t2 in the above-described state CS1. The first threshold value TA1 is a threshold value for the pressure as it drops during the period Tp after having risen to the pressure P1 as a target value, and is thus also referred to as a first pressure drop threshold value TA1. In the present embodiment, the first threshold value TA1 is set at a value, for which measurement error by the pressure sensor 64 is taken into consideration, in addition to the pressure value at the timing t2 in the state CS1; however, the pressure value at the timing t2 in the state CS1 may be employed as-is. The second threshold value TA2 is substantially the same value as the pressure inside the space Sp2 at the timing t2 in the above-described state CS3. In the present embodiment, the second threshold value TA2 is set at a pressure value, for which measurement error by the pressure sensor 64 and a natural drop in the internal pressure due to leakage of air inside the space Sp2 to the exterior are taken into consideration, in addition to the pressure value at the timing t2 in the state CS3; however, the pressure value at the timing t2 in the state CS3 may be employed as-is. The respective threshold values TA1, TA2 are stored in advance in the memory of the determination mechanism 60.

Figure 9:
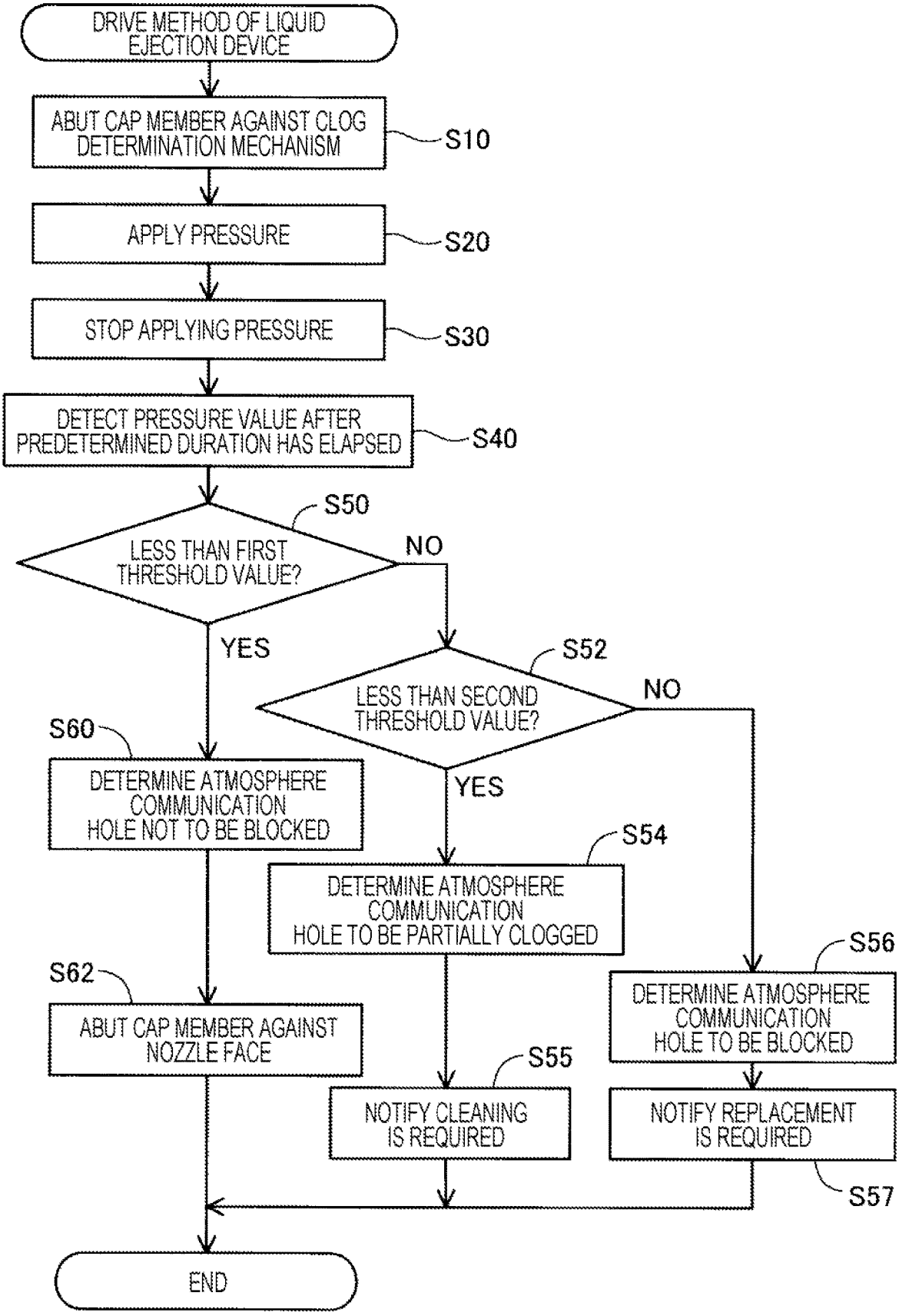
FIG. 9 is a flowchart illustrating a liquid ejection device drive method executed by a printing device.

Next, explanation follows regarding a drive method executed by the printing device 100 of the present embodiment, with reference to FIG. 9. FIG. 9 is a flowchart illustrating a liquid ejection device drive method executed by the printing device 100 of the present embodiment. The flow illustrated in FIG. 9 starts when a user operation to switch off the power source of the printing device has been received. The flow may also start when a user interrupt operation to perform maintenance on the printing device 100 has been received, or before and after processing to cause the cap member 70 to contact the head unit 80 after printing processing has ended.

At step S10, the control section 90 moves the determination mechanism 60 to the home position and causes the cap member 70 and the determination mechanism 60 to contact each other as illustrated in the example in FIG. 5. The cap recess 72 of the cap member 70 is fitted over the surface 60*a* so as to cover the opening 63*a* of the supply path 63 and the measurement opening 64*a* of the pressure sensor 64 of the determination mechanism 60, thereby forming the space Sp2.

At step S20, the control section 90 drives the pump 62 to increase the pressure inside the space Sp2 and raise the internal pressure of the space Sp2 to the pressure P1. At step S30, the control section 90 stops the pump 62 when the internal pressure of the space Sp2 reaches the pressure P1. At step S40, the determination section 66 detects the internal pressure of the space Sp2 using the pressure sensor 64 when the period Tp has elapsed since stopping the pump 62.

At step S50, the determination section 66 reads the first threshold value TA1 stored in advance in the memory and compares the first threshold value TA1 against the pressure value detected at step S40. When the pressure value is less than the first threshold value TA1 (S50: YES), processing transitions to step S60, and the determination section 66 determines that the atmosphere communication hole 74 is not blocked. The fact that the atmosphere communication hole 74 is operating normally may be displayed on a non-illustrated display section of the printing device 100 so as to notify the user. At step S62, the cap member 70 is contacted against the nozzle face 30 so as to keep the nozzles Nz in a moist state, and the present flow is ended. However, when the pressure value is the first threshold value TA1 or above (S50: NO), processing transitions to step S52. The determination section 66 reads the second threshold value TA2 stored in advance in the memory and compares the second threshold value TA2 against the detected pressure value.

When the pressure value is less than the second threshold value TA2 (S52: YES), processing transitions to step S54. The determination section 66 determines that the atmosphere communication hole 74 is partially clogged, and outputs this determination result to the control section 90. At step S55, the control section 90 displays the fact the cap member 70 requires cleaning on the non-illustrated display section of the printing device 100 so as to notify the user, and the present flow is ended. When the pressure value is the second threshold value TA2 or above at step S52 (S52: NO), processing transitions to step S56, and the determination section 66 determines that the atmosphere communication hole 74 is completely blocked. The determination section 66 outputs this determination result to the control section 90. At step S57, the control section 90 displays the fact that that the cap member 70 needs to be replaced on the display section of the printing device 100 so as to notify the user, and the present flow is ended. Instead of notifying that the cap member 70 needs to be replaced, notification may be made that the cap member 70 needs to be repaired.

As described above, the printing device 100 of the present embodiment includes the determination mechanism 60 that determines whether or not the atmosphere communication hole 74 of the cap member 70 is blocked. This enables blockage issues of the atmosphere communication hole 74 to be identified at an early stage, thereby suppressing poor ejection from the liquid ejection head 83 caused by the cap member 70.

In the printing device 100 of the present embodiment, the determination mechanism 60 determines whether or not the atmosphere communication hole 74 is blocked based on a result of changing the internal pressure of the space Sp2 using air conveyed under pressure by the pump 62. Namely, the printing device 100 of the present embodiment uses gas to determine whether or not the atmosphere communication hole 74 is blocked. This enables the blocked state of the atmosphere communication hole 74 to be determined by a simple method while reducing effects arising due to the shape of the atmosphere communication hole 74 and the like.

In the printing device 100 of the present embodiment, employing a pressure value that is greater than the first threshold value TA1 as the second threshold value TA2 enables a blocked state of the atmosphere communication hole 74 to be determined in separate stages, i.e. by determining whether or not a blockage exists, and then determining whether or not the clogging is partial. Furthermore, a user can be notified of the required action corresponding to the blocked state of the atmosphere communication hole 74, enabling issues with the atmosphere communication hole 74 to be resolved at an early stage.

B. Other Embodiments (B1)

In the above embodiment, the determination mechanism 60 includes the pump 62, the supply path 63, the pressure sensor 64, and the determination section 66. Air is conveyed under pressure into the space Sp2 by the pump 62 to raise the internal pressure, and a blocked state of the atmosphere communication hole 74 is determined based on the pressure value after the period Tp has elapsed. In contrast thereto, for example, configuration may be made in which air is be sucked out from the space Sp2 using a pump 62 configured by a vacuum pump so as to lower the pressure to a target value, and the atmosphere communication hole 74 is determined to be blocked in a case in which the pressure inside the space Sp2 is lower than a first pressure rise threshold value when a predetermined period has elapsed. In addition to, or instead of a pressure value of the interior of the space Sp2, the determination mechanism 60 may employ an optical detection method, in which for example a light is shone through the one end side of the atmosphere communication hole 74, and a determination is made based on the amount of light received at the opening on the other end side. Alternatively, configuration may be made in which a fluid is supplied through the one end side of the atmosphere communication hole 74, the flow rate of the fluid discharged through the opening on the other end side is detected, and a blocked state of the atmosphere communication hole 74 is determined based on the value or a change amount of the flow rate on the other end side.

(B2)

In the above embodiment, the Z direction side surface of the determination mechanism 60 has a planar shape, the gasket 73 includes an opening with a size capable of enclosing the outer profile of the nozzle face 30, and the gasket 73 of the cap member 70 contacts the surface 60*a* that configures the fitting section of the determination mechanism 60. In contrast thereto, the determination mechanism 60 may be configured smaller than the opening in the gasket 73. The fitting section of the determination mechanism 60 does not have to be planar on the Z direction side, and may for example be a dome-shaped recess that encloses the vicinity of the space Sp2 side opening of the atmosphere communication hole 74. Alternatively, the fitting section may have a probe shape such that the supply path 63 of the determination mechanism 60 extends toward the Z direction side, and an opening 63*a* at a tip of the probe fits over the cap member 70 so as to cover the vicinity of the opening of the atmosphere communication hole 74 and thereby couple the measurement opening 64*a* of the pressure sensor 64 to the inside of the supply path 63. In such a configuration, the space Sp2 may be formed by contacting the fitting section directly against the surface of the base 71 in the vicinity of the opening of the atmosphere communication hole 74, instead of against the gasket 73. This enables the volume of the space Sp2 to be reduced, thereby enabling the target pressure value to be reduced, the pressure rise period to reach the target pressure value to be shortened, the pump 62 to be made smaller in size, and so on.

(B3)

In the above embodiment, the determination mechanism 60 employs the first threshold value TA1 and the second threshold value TA2 to determine a blocked state of the atmosphere communication hole 74; however, a configuration may be applied in which only the first threshold value TA1 is employed. In such cases, the steps S52, S54, and S55 are omitted from the processing by the determination section 66, and when the detected pressure value is not less than the first threshold value TA1 (S50: NO), processing transitions to step S56 and the atmosphere communication hole 74 is determined to be blocked.

(B4)

In the above embodiment, the user notification processing at step S55 and step S57 may be omitted.

(B5)

In the above embodiment, the atmosphere communication hole 74 is formed as a through-hole with a diameter of 1 mm; however, the diameter may be less than 1 mm, and the opening diameter and flow path resistance of the atmosphere communication hole 74, the volume of the space Sp1, and so on may be formed with sizes such that pressure escapes to the surrounding atmosphere so as to maintain the pressure inside the space Sp1 at substantially atmospheric pressure, while also achieving the function of keeping the ink inside the nozzles Nz moist. The atmosphere communication hole 74 may have various shapes, for example a polygonal shape such as a square conduit or triangular conduit instead of a circular tube shape, and the atmosphere communication hole 74 may be bent instead of being straight. Namely, various shapes of flow path may be adopted in order to place the space Sp1 and the surrounding atmosphere in communication with each other. The atmosphere communication hole 74 may have a diameter of greater than 1 mm. In such a configuration, for example, a porous member may be provided inside the atmosphere communication hole 74.

(B6)

In the above embodiment, the determination mechanism 60 is fixed to the carriage 81 at a position adjacent to the head unit 80; however, the determination mechanism 60 may be configured as a separate body that is not fixed to the head unit 80.

(B7)

Instead of setting pressure values as the respective threshold values TA1, TA2, rates of pressure change as the period Tp elapses after rising to the pressure P1 target value may be set as the respective threshold values TA1, TA2. In such a configuration, the pressure sensor 64 successively detects the internal pressure plural times within the period Tp.

(B8)

The determination mechanism 60 may detect differences in the time taken to rise to the pressure P1 or differences in the pressure value at the timing t1 in order to determine a blocked state of the atmosphere communication hole 74. This enables a blocked state of the atmosphere communication hole 74 to be detected at an even earlier stage.

C. Other Aspects

The present disclosure is not limited to the above-described embodiments, and various other aspects may be implemented within a range not departing from the spirit of the present disclosure. For example, the present disclosure may also be implemented by the following aspects. Technological features in the above embodiments corresponding to technological features in the respective aspects described below may be switched or combined as appropriate in order to resolve some or all of the issues addressed by the present disclosure, or to realize some or all of the advantageous effects of the present disclosure. Moreover, technological features not described as being essential to the present specification may be omitted as appropriate.

(1)

One aspect of the present disclosure provides a liquid ejection device having a liquid ejection head including a nozzle face provided with a nozzle configured to eject a liquid. The liquid ejection device further includes a cap member configured to contact the nozzle face at a position enclosing the nozzle and to be fitted so as to cover the nozzle, the cap member being formed with an atmosphere communication hole to place an inside of the cap member and a surrounding atmosphere in communication with each other, and a clog determination mechanism configured to determine whether or not the atmosphere communication hole is in an at least partially blocked state. The liquid ejection device of this aspect includes the cap member configured to prevent the evaporation of ink in the nozzle and an accompanying increase in ink viscosity, and also includes the clog determination mechanism configured to determine a blocked state of the atmosphere communication hole in the cap member. This enables blockage issues of the atmosphere communication hole to be identified at an early stage, thereby suppressing poor ejection from the liquid ejection head.

(2)

In the liquid ejection device of the above aspect, the clog determination mechanism may include a fitting section to which the cap member is fitted, a pressure adjustment section configured to change a pressure inside a space enclosed by the cap member and the fitting section in a state in which the cap member is fitted over the fitting section, a pressure detection section configured to detect the pressure, and a determination section configured to determine whether or not the atmosphere communication hole is in an at least partially blocked state based on a change in the pressure as detected by the pressure detection section. In the liquid ejection device of this aspect, the pressure inside the space enclosed by the cap member and the clog determination mechanism is changed by the pressure adjustment section, and determination as to whether or not the atmosphere communication hole is blocked is made based on this change in pressure. Namely, gas is used to determination as to whether or not the atmosphere communication hole is blocked. This enables a blocked state of the atmosphere communication hole to be determined by a simple method while reducing effects arising due to the shape of the atmosphere communication hole in the cap member and the like.

(3)

Another aspect of the present disclosure provides a method for driving a liquid ejection device provided with a liquid ejection head including a nozzle face provided with a nozzle configured to eject a liquid. The method includes fitting a clog determination mechanism configured to determine whether or not an atmosphere communication hole is in an at least partially blocked state to a cap member formed with the atmosphere communication hole to place an inside of the cap member and a surrounding atmosphere in communication with each other, so as to form a space enclosed by the cap member and the clog determination mechanism, raising or lowering a pressure inside the space from an atmospheric pressure to a target value, and determining that the atmosphere communication hole is in an at least partially blocked state in one of a case in which the pressure inside the space is a first pressure drop threshold value or above when a predetermined period elapses after the pressure is raised to the target value, and a case in which the pressure inside the space is lower than a first pressure rise threshold value when a predetermined period elapses after the pressure is lowered to the target value. The liquid ejection device drive method of this aspect enables determination to be made as to whether or not the atmosphere communication hole in the cap member is blocked. This enables blockage issues of the atmosphere communication hole to be identified at an early stage, thereby suppressing poor ejection from the liquid ejection head.

(4)

The method for driving a liquid ejection device of the above aspect may further include notifying that at least one of replacement, repair, and cleaning of the cap member is required in a case in which the pressure inside the space is the first pressure drop threshold value or above when the predetermined period elapses after the pressure is raised to the target value, and in which the pressure inside the space is a predetermined second threshold value or above, the second threshold value being larger than the first pressure drop threshold value. In the liquid ejection device drive method of this aspect, employing a higher pressure value than the first threshold value as the second threshold value enables a blocked state of the atmosphere communication hole to be determined in separate stages. Further, a user can be notified of the required action corresponding to the determination result, enabling issues with the atmosphere communication hole to be resolved at an early stage.

The present disclosure may be realized in various formats other than a liquid ejection device. For example, the present disclosure may be realized in a format such as a manufacturing method for a liquid ejection device, a control method for a liquid ejection device, a computer program for implementing such a control method, or a non-transitory recording medium stored with such a computer program.

What is claimed is:

1. A liquid ejection device comprising:

a liquid ejection head including a nozzle face provided with nozzles configured to eject a liquid;

a cap member configured to cover the nozzles when the cap member contacts the nozzle face at a position enclosing the nozzles so that the nozzles are in an inside of the cap member, the cap member having an atmosphere communication hole that allows the inside of the cap member and a surrounding atmosphere to communicate with each other, one end of the atmosphere communication hole having an opening inside the cap member, other end of the atmosphere communication hole having an opening outside the cap member; and a clog determination mechanism including a fitting section that covers a space enclosing one of the one end opening and the other end opening of the atmosphere communication hole, and configured to determine whether or not the atmosphere communication hole is in an at least partially blocked state in a case where the space is covered with the fitting section while the other one of the one end opening and the other end opening of the atmosphere communication hole communicates with the surrounding atmosphere.

2. The liquid ejection device according to claim 1, wherein the clog determination mechanism includes a pressure adjustment section configured to change a pressure inside the space covered with the fitting section, a pressure detection section configured to detect the pressure, and a determination section configured to determine whether or not the atmosphere communication hole is in an at least partially blocked state based on a change in the pressure as detected by the pressure detection section.

3. A method for driving a liquid ejection device comprising a liquid ejection head including a nozzle face provided with nozzles configured to eject a liquid, and a cap member configured to cover the nozzles when the cap member contacts the nozzle face at a position enclosing the nozzles so that the nozzles are in an inside of the cap member, the cap member having an atmosphere communication hole that allows the inside of the cap member and a surrounding atmosphere to communicate with each other, one end of the atmosphere communication hole having an opening inside the cap member, other end of the atmosphere communication hole having an opening outside the cap member, the method comprising:

covering a space enclosing the one of the one end opening and the other end opening of the atmosphere communication hole while the other one of the one end opening and the other end opening of the atmosphere communication hole communicates with the surrounding atmosphere;

raising or lowering a pressure inside the space from an atmospheric pressure to a target value; and determining that the atmosphere communication hole is in an at least partially blocked state in one of a case in which the pressure inside the space is a first pressure drop threshold value or above when a predetermined period elapses after the pressure is raised to the target value, and a case in which the pressure inside the space is lower than a first pressure rise threshold value when a predetermined period elapses after the pressure is lowered to the target value.

4. The method for driving a liquid ejection device according to 3, further comprising notifying that at least one of replacement, repair, and cleaning of the cap member is required in a case in which the pressure inside the space is a second threshold value or above when the predetermined period elapses from the pressure is raised to the target value, the second threshold value being larger than the first pressure drop threshold value.

* * * * *